United States Patent [19]

Beveridge

[11] 4,270,023

[45] May 26, 1981

[54] CYLINDRICAL SPEAKER MECHANISM

[76] Inventor: Harold N. Beveridge, 505 E. Montecito St., Santa Barbara, Calif. 93103

[21] Appl. No.: 44,127

[22] Filed: May 31, 1979

[51] Int. Cl.[3] ..... H04R 5/02

[52] U.S. Cl. ..... 179/1 GA; 179/1 E

[58] Field of Search ..... 179/1 E, 1 GA; 181/31 B, 31, 27, 153, 176

[56] References Cited

U.S. PATENT DOCUMENTS

| | | | |
|---|---|---|---|
| 3,371,742 | 3/1968 | Norton | 181/31 |
| 3,668,335 | 6/1972 | Beveridge | 181/27 |
| 3,834,485 | 9/1974 | Deschek | 181/31 B |
| 3,945,461 | 3/1976 | Robinson | 181/153 |
| 3,978,941 | 9/1976 | Siebart | 179/1 GA |
| 3,980,829 | 9/1976 | Beveridge | 179/1 GA |

*Primary Examiner*—Terrell W. Fears

*Attorney, Agent, or Firm*—Griffin, Branigan & Butler

[57] ABSTRACT

A loudspeaker (10) has a vertically-elongated cylindrical cabinet which houses both a waveform generator (54) and a pair of sub-woofers (46, 48). The sub-woofers (46, 48) are situated near the top and bottom of the cylindrical cabinet and generate a uniform low frequency response which has in-time coherence with a cylindrical wavefront produced by the generator (54).

13 Claims, 4 Drawing Figures

CYLINDRICAL SPEAKER MECHANISM

BACKGROUND

This invention relates to loudspeakers and stereophonic systems.

As opposed to a point, or spherical acoustic source, a line, or cylindrical acoustic source positioned vertically in a room emits only a horizontal sound waveform. Thus, if the cylindrical source extends substantially from the floor of the room to the ceiling, there is no vertical energy component which might result in reflection of the sound wave at the floor or ceiling. As a result, the waveform that spreads into the room has a more uniform, intense pattern than that emitted from a spherical source, especially as the distance between the source and a listener increases.

The foregoing considerations were incorporated into U.S. Pat. No. 3,980,829 issued to the applicant herein. The disclosure of that patent is incorporated herein by reference and includes a loudspeaker and stereophonic system employing a semi-cylindrical waveform generator. The waveform generator of that patent comprises an elongated driver means, such as a planar sound transducer, capable of generating frequencies through substantially the entire audible range, which emits sound through an acoustical lens structure. The waveform generator and the lens employed therein have a vertical extent approximating a floor-to-ceiling height, thereby spanning the level of seated and standing listeners. The vertically elongated lens structure facilitates the generation of a uniform cylindrical sound wave that includes substantially the entire audible frequency range.

The acoustical lens structure of U.S. Pat. No. 3,980,829 comprises a series of walls which are straight in the vertical direction but are spaced apart and curved in accordance with a special pattern in the horizontal direction to define a series of channels. With respect to the special pattern, the walls simultaneously curve together to a narrow throat region and then simultaneously diverge to an outlet aperture.

The above described lens structure employed for generating the highly desirable, uniform, cylindrical sound wave uses considerable power to produce uniform acoustical loudness, or volume, through substantially the entire audible acoustic range. More specifically, a disproportionate amount of power is used to squeeze the lower frequencies through the narrow throat region of the lens structure, particularly when the driver is an electrostatic transducer.

One alternative to this power, or volume, constraint is to enlarge the throat region of the lens structure. However, this would necessitate considerable expansion of the speaker cabinet, which would generally be undesirable to consumers planning to use the speakers in relatively small rooms.

A second alternative is to employ a separate unit, termed a "sub-woofer", to generate the lowest audible frequencies below a cross-over frequency. A primary driver or generator would simultaneously generate all audible frequencies above the cross-over frequency. Hence, the lens structure and cabinet housing the primary driver and the lens could remain conveniently compact.

When a sub-woofer unit is used in conjunction with the primary driver as suggested above, a question arises regarding the physical placement in the room of the sub-woofer unit. When the cross-over frequencies are low, it may be possible (although not necessarily desirable) to locate the sub-woofer unit fairly distant from the primary generator. At these very low frequencies a listener in the room is not quite as sensitive to the time delay arising from the differing path lengths travelled by the low and high frequencies which emanate from the respective distantly separated sources. However, when desiring to utilize less operating power, and accordingly desiring to have a higher cross-over frequency, the human ear becomes acutely aware of the time delay of the shorter wavelengths in the vicinity of the cross-over frequency. The time delay results in confusion which can be both unpleasant and fatiguing.

Numerous conventional stereo systems house both a tweeter and a woofer in a speaker cabinet. However, these systems cannot adequately address the time delay problem since, having two discrete sources neither of which generates a cylindrical wavefront, either an off-axis vertical or horizontal delay degrades the quality of the sound.

Generation of low frequencies generally, either by a single woofer or a single primary driver, further involves standing wave complications, especially in a relatively small room. At these low frequencies the room dimensions are typically one or two standing-wave wavelengths. As a result, there are very broad low-frequency amplitude variations throughout the room. For example, in areas in the room where standing wave nulls occur, the amplitude, or volume, may be diminished by as much as 20 dB or even 30 dB.

The low frequency standing wave problem is not remedied in the conventional stereo system which typically employs two cabinets. In such systems the speakers are generally located horizontally symmetric with respect to a listener region since it is desirable that the high frequencies be symmetric. However, horizontal symmetric placement of the cabinets and speakers contained therein produces the same low frequency amplitude—probably diminished—at the listener region which is horizontally equidistant from each speaker cabinet.

In view of the foregoing, an object of the invention is to provide a loudspeaker which produces a uniform low frequency response which retains its time coherence with the cylindrical waveform.

Practically all loudspeaker structures give rise to a back wall reflection. That is, some of the energy generated by the driving transducer travels backward with respect to the transducer rather than forward through a speaker opening. Thus, backward-moving energy is reflected from the back wall of the speaker cabinet so that it travels back through the virtually transparent transducer and interfers with the forward moving energy wave, thus degrading the sound quality. The back wall reflection is particularly egregious in loudspeakers having a flat, or planar, back wall, since the backward energy is reflected at 180° to its incident angle and produces a planar wavefront which is more destructive since it is in uniform phase with respect to the direction of the forward moving sound. In this respect, an advantage of the structure about to be described is the reduction of the back wall reflection problems in a loudspeaker.

Most loudspeakers also suffer from sound degradation caused by diffraction effects as the sound wave washers out over the edges of the cabinet containing the speaker. This diffraction, occuring at the edges of the cabinet, causes further interference with the forward-moving waves, thereby tending to diminish sound uniformity and clarity in the listener region. An advantage of the structure about to be described, therefore, is the reduction of diffractive effects associated with a loudspeaker.

SUMMARY

The loudspeaker hereinafter described has a cylindrical cabinet which extends substantially from the floor to the ceiling of a room. A waveform generator housed in the cylindrical loudspeaker cabinet generates a uniform cylindrical sound wave through a vertical cabinet outlet.

The loudspeaker utilizes two sub-woofer units to produce a uniform low frequency response. The sub-woofer units are situated at the top and the bottom of the cylindrical cabinet. The low frequencies thusly emitted from sub-woofer units proximate the waveform generator retain time coherence with the uniform cylindrical sound wave. Additionally, since a listener is generally sitting or standing at an elevation which is not vertically symmetrical with respect to the two sub-woofer units, the sound degradation due to standing wave nulls is reduced.

The cylindrical exterior surfaces of the loudspeaker cabinet are corner-free and thus do not cause diffraction effects. Further, the cylindrical interior surface of the loudspeaker cabinet provides a non-planar back wall which disperses backward-moving sound so that it is not destructively in phase.

BRIEF DESCRIPTION OF THE DRAWINGS

The foregoing and other objects, features, and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating principles of the invention.

DETAILED DESCRIPTION OF THE DRAWINGS

Figure 1:
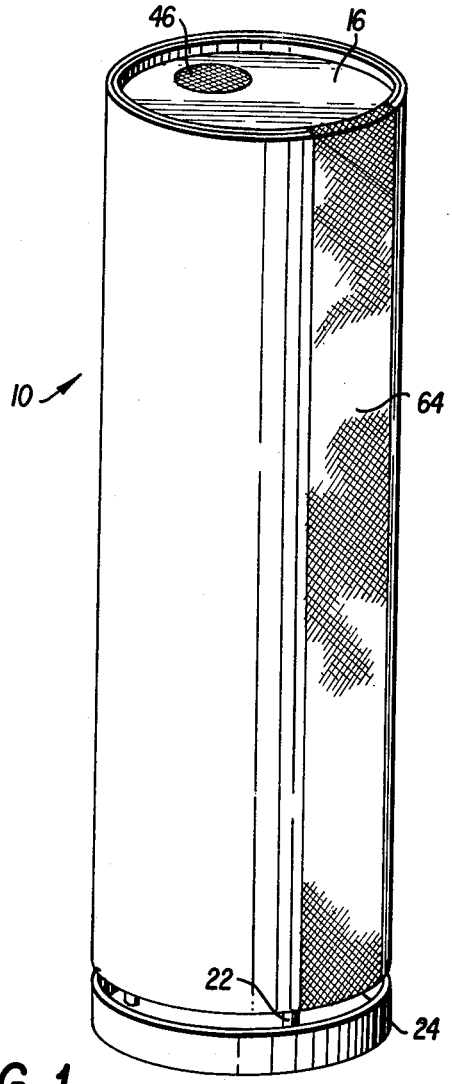
FIG. 1 is a perspective view of the loudspeaker according to one embodiment of the invention.

FIG. 1 illustrates a cylindrical loudspeaker 10 well suited for use in a relatively small room, such as a room in a home. The cylindrical loudspeaker 10 extends from near the floor of the room toward the ceiling and above a listener region. In one embodiment the height of loudspeaker 10 approximates a floor-to-ceiling relationship, spanning between and extending beyond the normal seated and standing positions, generally including points $\frac{1}{2}$ meters and $1\frac{3}{4}$ meters above the floor.

Figure 2:
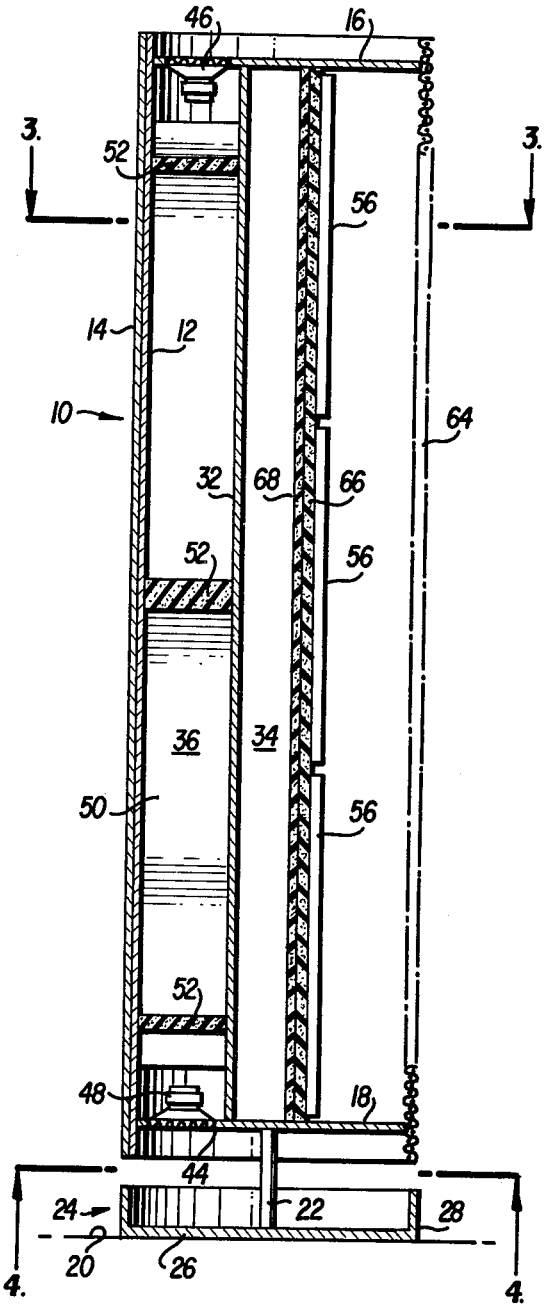
FIG. 2 is a sectional view of the FIG. 1 structure taken along the lines 2—2 thereof.

As seen in FIG. 2, loudspeaker 10 comprises a vertical cylindrical cabinet having a vertical side surface 12 which is preferably formed from cardboard. Adhered to the exterior of side surface 12 is an outer covering 14 which can be, for example, a panel of kerfed wood. In one embodiment the thickness of the cardboard vertical side surface 12 approximates 3/16ths inch and the width of the outer wooden covering 14 approximates $\frac{1}{8}$th inch.

The cabinet of loudspeaker 10 further comprises a cabinet top surface 16 and a cabinet bottom surface 18. As shown in the FIG. 2 embodiment, the surfaces 16 and 18 are discs, preferably of wood, which are slightly recessed from the ends of the vertical side surface 12 and sealed therein to provide an air-tight cabinet. Although the cabinet top surface 16 and the cabinet bottom surface 18 are illustrated in the FIG. 2 embodiment to be parallel to a floor 20 and parallel to one another, it should be understood that in some embodiments either one or both of the surfaces 16, 18 may be inclined at an angle with respect to the floor 20.

Figure 4:
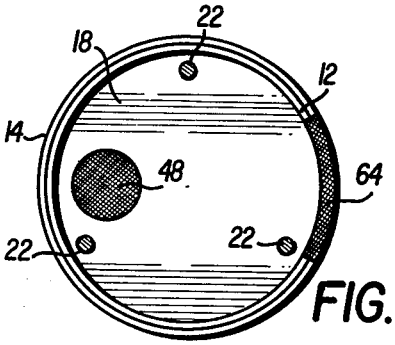
FIG. 4 is a sectional view of FIG. 2 taken along the lines 4—4 thereof.

FIG. 2 in conjunction with FIG. 4 illustrates that the cabinet bottom surface 18 is supported on three bolts 22 which are anchored in a base member 24. The bolts 22 are slightly inset from the periphery of base member 24. The base member 24 comprises a wooden disc 26 which lies on the floor 20 and an outer covering 28 which wraps around the periphery of the disc 26 from the floor to a height approximately one inch short of the cabinet vertical side surface 12, thereby forming an annular gap 30 between the base member 24 and the loudspeaker cabinet.

Figure 3:
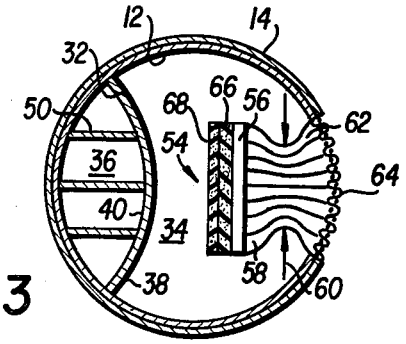
FIG. 3 is a sectional view of FIG. 2 taken along the lines 3—3 thereof.

Within the cabinet created by the vertical side surface 12, the top surface 16, and the bottom surface 18, is a vertical partition 32 which extends substantially from the cabinet bottom surface 18 to the cabinet top surface 16. The vertical partition 32 thus defines a large compartment 34 and a small compartment 36 within the cabinet. As seen in FIG. 3, the vertical partition 32 has an arcuate cross-section so that the large compartment 34 sees a convex surface 38 of the partition 32 and the small compartment 36 sees a concave surface 40 of the partition 32.

With further regard to the small compartment 36, the cabinet top surface 16 and the cabinet bottom surface 18 each have an aperture therein indicated as 42 and 44, respectively. A first low frequency generator, such as sub-woofer 46, is installed in the aperture 42 of the cabinet top surface 16 and a second low frequency generator, such as sub-woofer 48, is likewise installed in aperture 44.

Spanning the small compartment 36 are three brace members 50 (FIG. 3) which extend vertically substantially from near sub-woofer 48 to near sub-woofer 46. The brace members 50 connect the concave surface 40 of the vertical partition 32 with the interior of the cabinet vertical side surface 12. As shown in the FIG. 2 embodiment the small compartment 36 is also spanned by three horizontal layers of acoustic absorbant foam.

The large compartment 34 houses a waveform generator 54 which includes a vertically elongated driver means 56 which is juxtaposed with a lens structure 58. Both the driver means 56 and the lens structure 58 extend substantially from the cabinet bottom surface 18 to the cabinet top surface 16. The large compartment 34 has several times the volume of the lens structure 58 contained therein in order to provide sufficient breathing space for the driver means 56 to generate the mid to lower frequencies.

As illustrated in FIGS. 2 and 3, driver means 56 is planar and extends across approximately one half of the full diameter of the cylindrical loudspeaker 10. Instead of employing a series of planar drivers mounted one above another as illustrated in FIG. 2, a unitary elongated driver may be constructed.

In the above regard, the driver 30 may either be of the electrostatic or of the electromagnetic type. An electrostatic transducer loudspeaker performs admirably in cylindrical floor-to-ceiling waveform generators. In this connection, refer to U.S. Pat. Nos. 3,668,335 and 3,980,829, incorporated herein by reference. Further, the invention can employ one or more planar electromagnetic speakers for the driver 56 or even a series of cone-shaped electromagnetic speakers stacked vertically in order to simulate a planar surface approximating a floor-to-ceiling height.

The lens structure 58 of the waveform generator 54 comprises a series of channels (FIG. 3) which include substantially straight central channels and relatively curved outer channels which first converge toward each other to a constricted throat region 60 and thereafter diverge to an outlet aperture 62. For a more specific discussion of the lens structure 58 of the invention, reference is again made to U.S. Pat. No. 3,980,829 which furnishes adequate explanation. The outlet 62 of lens structure 58 is covered with a conventional transparent foam fabric 64.

The back of driver means 56 has applied thereto a first layer of acoustic dampening material 66 and a second layer of acoustic dampening material 68. Preferably, the first layer 66 is a three inch deposit of urethane foam and the second layer 68 is a ¾ inch deposit of a much denser foam which will have approximately 3 times as much attenuation.

In operation, the waveform generator 54 produces a uniform cylindrical wave extending substantially from the floor to the ceiling. As explained in the patents previously cited herein, the lens structure 58 transforms a planar sound wave generated by the driver means 56 into a cylindrical wavefront which emanates from the outlet aperture 62. In this regard, the frequencies generated by driver means 56 are those frequencies greater than a cross-over frequency below which the sub-woofers 46 and 48 are operative. For example, in one embodiment of the invention the cross-over frequency is approximately 300 Hz. It should be understood that the cross-over frequency may be selected as desired according to operating constraints or preferences associated with various embodiments.

The lowest frequencies, in particular those below the cross-over frequency, are generated by the two sub-woofers 46 and 48 positioned in the cabinet top surface 16 and the cabinet bottom surface 18. The very low frequencies emitted by the sub-woofers 46 and 48 have very long wavelengths—generally on the order of 5 feet—and thus are not diffracted over the top and bottom edges of the cabinet which have dimensions much smaller by comparison.

As seen in FIG. 2, the sub-woofers 46 and 48 are located very close to the plane of the driver means 56. For example, in one embodiment this distance is less than a foot or, stated with respect to the low frequency emitted, less than 1/5th wavelength. The close proximity of the sub-woofers 46 and 48 to the driver means 56 generally results in the simultaneous reception of coherent sound from all sources. While for some positions in the room, particularly a position directly in front of an individual speaker, the low frequencies may arrive very slightly behind the cylindrical waveform, at other positions which are off-center from the position directly in front of the loudspeaker the low frequencies tend to catch up. Since normally two speakers are operated, the listener is generally in a position 60° off-center with respect to the front of each speaker and thus at a position where the low frequency response and cylindrical waveform arrive together so that in-time coherence results.

The sub-woofers 46 and 48 are not vertically symmetrical with respect to the listener region. For example, if a listener were sitting in a room containing the loudspeaker 10, the ears of the listener would generally be about 1 meter above the floor. On the other hand, if the listener were standing erect, the listener's ears would generally about 1¾ or possibly 2 meters above the floor. In either of these listening positions the ears of the listener would be closer to one sub-woofer than the other. As a result, the standing-wave amplitude nulls perceived from the respective sub-woofers are not the same. In fact, sub-woofer 46 will not produce a standing wave amplitude null in the same position as the sub-woofer 48. Thus, the loudspeaker 10 uses its height to an advantage to produce a more uniform low frequency response by scrambling the standing wave amplitude nulls which occur in the room.

The small compartment 36 of the loudspeaker 10 contains the sub-woofers 46 and 48 and as such is subject to compression and tension forces as the low frequencies are produced. Previous loudspeakers have employed woofer units which are cubical and have flat surfaces. In these various planar structure models structural stability is due only to a bending moment. However, in loudspeaker 10 the small compartment 36 functions as a sub-woofer compartment which has more structural stability since the bending moment is eliminated and the tension is absorbed in the walls 12, 32. Thus, the small compartment 36 is less capable of vibrating.

In the above regard, the embodiment of FIG. 3 depicts a sub-woofer compartment 36 having three braces 50 which preclude the relative vibrations, or breathing, of the compartment and thus stabilize the structure. In this regard, it should be understood that the brace structure itself or the number of braces employed is not critical to the invention.

As discussed hereinabove, some of the energy generated by the waveform generator 46 travels backwards into the cabinet instead of forward through the lens structure 58. The layers of acoustic damping material 66 and 68 applied to the back of the driver means 56 functions to absorb much of the backward-moving energy. In particular, the denser layer 68 is significant to attenuate the backward-moving low frequencies.

The small amount of backward-moving energy that is not absorbed by the layers 66 and 68 is reflected from the convex surface 38 of the vertical partition 32. Since the angle of acoustic reflection is equal to the angle of acoustic incidence, the convex surface 38 serves to disperse the reflected energy at various angles so that it does not reflect destructively.

Since the loudspeaker 10 has a cylindrical cabinet, the cylindrical waveform emitted from the waveform generator 54 is not diffracted by cabinet edges such as those occuring in rectangular or cubic-type cabinet speakers. As a result, there is no diffractive component to interfere with the cylindrical waveform.

While the invention has been particularly shown and described with reference to preferred embodiments thereof, it will be understood by those skilled in the art that various alterations in form and detail may be made therein without departing from the spirit and scope of the invention. For example, the foam fabric 64 used to cover the outlet aperture 62 may be replaced with an appropriate grille structure.

What is claimed is:

1. A loudspeaker for use in a room having a ceiling and a floor comprising:

a cabinet extending substantially from near said floor toward said ceiling and above a listener region, said cabinet having a cabinet vertical axis, said cabinet having a cabinet top surface, a cabinet bottom surface, and at least one vertical side surface;

a waveform generator housed in said cabinet for generating a cylindrical wave front from said vertical side surface of said cabinet, said generator being capable of generating audible frequencies including frequencies above a cross-over frequency;

a first low frequency generator housed in said cabinet proximate said cabinet top surface for generating frequencies including frequencies below said cross-over frequency; and, a second low frequency generator housed in said cabinet proximate said cabinet bottom surface for generating frequencies including frequencies below said cross-over frequency, said first and said second low frequency generators being essentially vertically unsymmetrical with respect to the listener region.

2. The loudspeaker of claim 1, wherein said cabinet top surface and said cabinet bottom surface are parallel to said floor.

3. The loudspeaker of claim 1, wherein said cabinet is cylindrical with a major axis at said cabinet vertical axis.

4. The loudspeaker of claim 3 further comprising a vertical partition extending substantially from near said cabinet bottom surface to near said cabinet top surface, said vertical partition defining a large compartment and a small compartment in said cabinet, said large compartment for housing said waveform generator and said small compartment for housing said first and second low frequency generators.

5. The loudspeaker of claim 4, wherein said vertical partition has an arcuate cross section, said vertical partition having concave and a convex surfaces with respect to said cabinet vertical axis, said concave surface facing said small compartment and said convex surface facing said large compartment.

6. The loudspeaker of claim 5, further comprising at least one brace member spanning said small compartment, said brace member connected to said concave surface of said vertical partition and the interior of said cabinet vertical side surface.

7. The loudspeaker of claim 6, wherein said brace member extends vertically substantially from near said first low frequency generator to near said second low frequency generator.

8. The loudspeaker of claim 1, wherein said waveform generator further comprises a vertically-elongated driver means having a vertical axis, said driver means emitting sound through a lens structure, said lens structure formed by a series of walls which are parallel to the axis of said driver and form a series of channels, said channels, in cross-section perpendicular to said axis, including substantially straight central channels and relatively curved outer channels which first converge toward each other to a constricted throat region and thereafter diverge to an outlet aperture, said generator capable of generating a uniform cylindrical sound wave.

9. The loudspeaker of claim 8, wherein said driver means is an electrostatic transducer.

10. The loudspeaker of claim 8, wherein said driver means is an electromagnetic transducer.

11. The loudspeaker of claim 1, wherein said waveform generator comprises an electrostatic transducer.

12. The loudspeaker of claim 1, wherein said waveform generator comprises an electromagnetic transducer.

13. The loudspeaker of claim 1 wherein said cabinet extent includes the position of $\frac{1}{2}$ to $1\frac{3}{4}$ meters above the floor.

* * * * *